United States Patent [19]

Sayles

[11] Patent Number: 5,059,260

[45] Date of Patent: Oct. 22, 1991

[54] COMPOSITE ROCKET PROPELLANT COMPOSITION WITH A CONTROLLABLE PRESSURE EXPONENT

[75] Inventor: David C. Sayles, Huntsville, Ala.

[73] Assignee: The United States of America as represented by the Secretary of the Army, Washington, D.C.

[21] Appl. No.: 116,113

[22] Filed: Jan. 18, 1980

[51] Int. Cl.[5] ..... C06B 45/10

[52] U.S. Cl. ..... 149/192; 149/19.3; 149/19.6; 149/19.91; 149/20

[58] Field of Search ..... 149/19.3, 19.91, 19.6, 149/19.2, 20

[56] References Cited

U.S. PATENT DOCUMENTS

| | | | |
|---|---|---|---|
| 3,764,417 | 10/1973 | Hill et al. | 149/19.2 |
| 3,813,305 | 5/1974 | Baldwin et al. | 149/19.3 |
| 3,878,002 | 4/1975 | Baldwin | 149/19.91 |
| 3,914,139 | 10/1975 | Jones et al. | 149/19.91 |
| 3,932,241 | 1/1976 | Sayles | 149/19.3 |
| 3,933,542 | 1/1976 | Childs et al. | 149/19.3 |
| 4,001,057 | 1/1977 | Baldwin et al. | 149/19.91 |
| 4,072,546 | 2/1978 | Winer | 149/20 |
| 4,078,953 | 3/1978 | Sayles | 149/19.4 |
| 4,133,706 | 1/1979 | Shoults | 149/19.2 |

OTHER PUBLICATIONS

"SYFO Plasticizer Pilot Process", pp. 11–15 and 75, Report #RPL-TR-75-19, dated Apr. 1975, declassified on Dec. 31, 1978.

*Primary Examiner*—Edward A. Miller
*Attorney, Agent, or Firm*—Werten F. W. Bellamy; Anthony T. Lane

[57] ABSTRACT

Gem-difluoroamino compounds are employed as a partial or complete replacement for TVOPA (trisvinoxypropyl adduct), tris-1,2,3-[bis(1,2-difluoroamino)-ethoxy]propane, in accordance with the nomenclature established by the International Union of Pure and Applied Chemistry. A partial or complete replacement of the vicinal-(1,2-)difluoroamino plasticizer of a difluoroamino-based propellant with its structural isomer or a related structural isomer, namely, a geminal-(1,1-)bis-difluoroamino compound has resulted in two beneficial effects, namely, a marked reduction in pressure exponent and an enhancement of the burning rate of the propellant. Representative of the geminal compounds are the compounds identified as SYEP and SYPO and further identified by the following structural formulas and chemical nomenclatures:

SYEP $F(NO_2)_2C.CH_2.O.CH_2.C(NF_2)_2.CH_2.O.CH_2.C(NO_2)_2F$ or 5,5-bis[difluoroamino]-1,9-bis[dinitro]-1,9-difluoro-3,7-dioxanonane or 2,2-bis[difluoroamino]-1,3-bis[fluorodinitroethoxy]-propane

SYPO $F(NO_2)_2C.CH_2.C(NF_2)_2.CH_2.O.CH_2.O.CH_2.C(NF_2)_2.CH_2.CH_2.C(NO_2)_2F$ or 4,10-[bis(difluoroamino)-1,13-difluoro-1,13-bis(dinitro)]-6,8-dioxatridecane or 2,2-bis[difluoroamino]-bis[5-fluoro-5,5-dinitro]pentyl formal.

3 Claims, 2 Drawing Sheets

COMPOSITE ROCKET PROPELLANT COMPOSITION WITH A CONTROLLABLE PRESSURE EXPONENT

DEDICATORY CLAUSE

The invention described herein may be manufactured, used, and licensed by or for the Government for governmental purposes without the payment to me of any royalties thereon.

BACKGROUND OF THE INVENTION

Technological advances in propellantry have led to the development of a variety of active, self-deflagrating binders, of the difluoroamino type, for use in ultrahigh-burning rate, high-energy, composite propellants. However, these propellants tend to have pressure exponents near unity at the motor operating pressures which are characteristic of the advanced interceptors, and according to the propulsion subsystem design optimization study which was carried out, a pressure exponent in excess of 0.7 would be unacceptable for use in advanced interceptors. If the pressure exponent is in excess of this value, the thickness of the motor case would have to be considerably increased, with the result that the corresponding weight of the interceptor would be unnecessarily excessive.

The only readily-available methods for effecting some reduction of pressure exponent is to reduce the ammonium perchlorate content or resort to the use of ammonium perchlorate of larger weight-mean-diameter. These approaches are unacceptable because they adversely affect the burning rate. Burning rate promoters have been found to have little effect on the pressure dependence of the burning rate at these higher pressures. Similarly, the presence of aluminum has been found to have little effect.

Advantageous to the propellant performance parameters would be a means of effecting the pressure exponent without adversely affecting other desirable characteristics such as burning rate.

An object of this invention is to provide a method of controlling the pressure exponents of composite missile and rocket propellants.

A further object of this invention is to provide a method of lowering the pressure exponent of a composite rocket propellant to make the propellant acceptable for use in advanced interceptors wherein the weight and burning rate of the propellant are optimized for performance criteria.

SUMMARY OF THE INVENTION

Pressure exponents of composite propellants are markedly reduced while the burning rates are enhanced when a partial or complete replacement of the vicinal-(1,2-)difluoroamino plasticizer of a difluoroamino-based propellant is made by its structural isomer or a related structural isomer, namely, the geminal-(1,1-)difluoroamino compounds identified as SYEP and SYPO and further identified by the structural formulas and chemical nomenclatures disclosed herein.

A typical difluoroamino-based propellant which has been extensively investigated in an effort to achieve an ultrahigh-burning rate propellant is modified by replacing about 20% of the TVOPA with SYEP. SYPO is a second compound which can be used to replace a portion of TVOPA to achieve a reduction in pressure exponent and an enhancement of burning rate.

DESCRIPTION OF THE PREFERRED EMBODIMENTS

Figure 1:
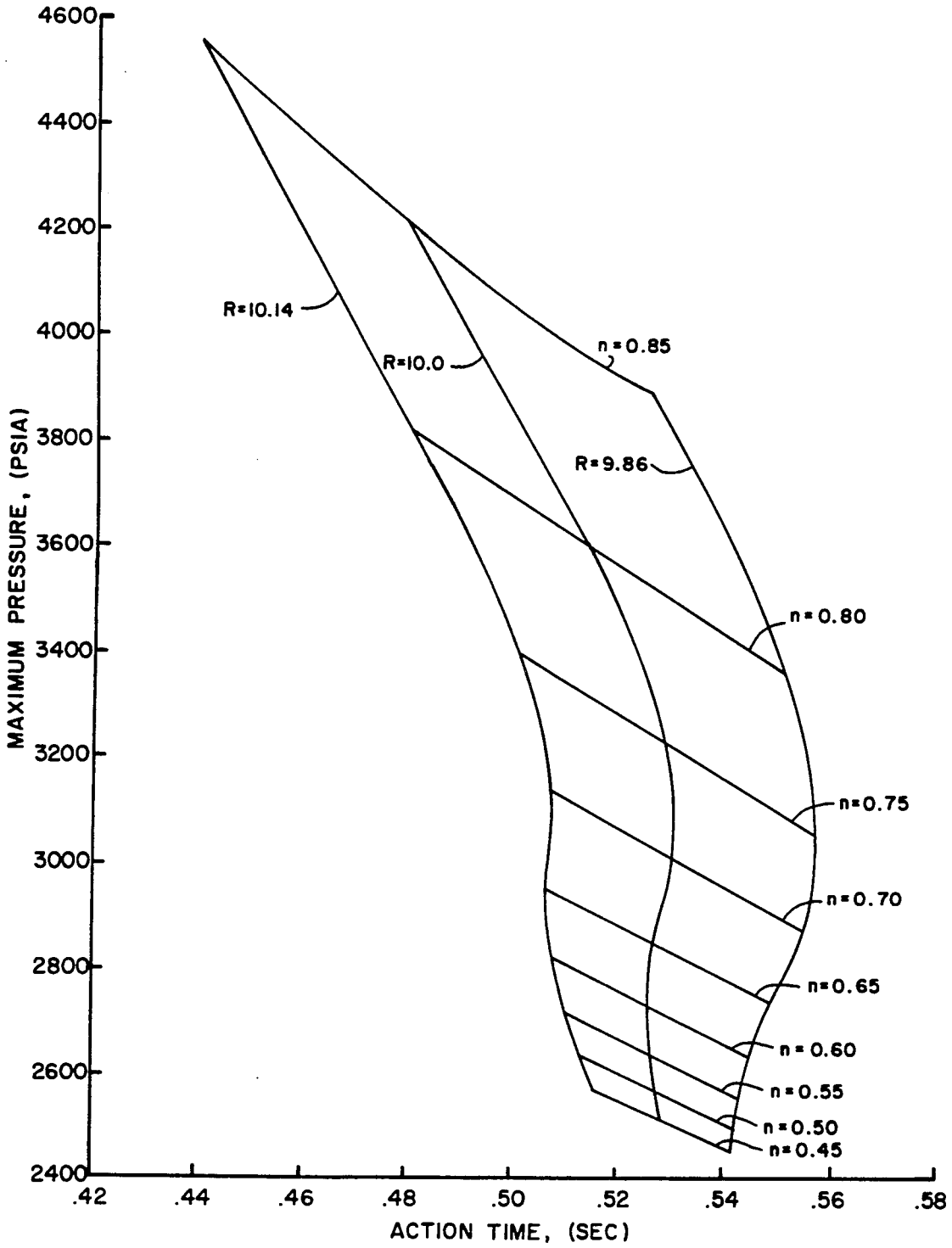
FIG. 1 is a plotting of maximum pressure (psia) and action time (sec) which depicts the affect of pressure exponent on the motors maximum operating pressure.

The partial or complete substitution of the vicinal-(1,2-)difluoroaminoplasticizer of a difluoroamino-based propellant with a geminal-(1,1-)difluoroaminocompound results in beneficial affects: (1) reduction in pressure exponent, and (2) enhancement of burning rate. Preferred geminal compounds used are SYEP, which is 2,2-bis(difluoroamino)1,3-bis(difluorodinitroethoxy)-propane, and SYPO, which is 2,2-bis(difluoroamino)-bis(5-fluoro-5,5-dinitro)pentyl formal.

Table I contains the composition of a typical difluoroamino-based propellant (Propellant A) which has been extensively investigated in an effort to achieve an ultrahigh-burning rate propellant in the burning rate regime of 20-ips at a motor operating pressure of 2000 psi. Propellant B is an experimental formulation which consists of a closely similar formulation to propellant A in which 20% of the TVOPA has been replaced with SYEP. The properties including burning rate, mechanical, and sensitivity are set forth in Table I for comparison. The improvements are discussed in further detail below.

The binder level in difluoroamino-plasticized propellants is high in comparison to other non-energetic binder-containing composite propellants. Because of this high percentage, the plasticizer constitutes one of the major propellant ingredients. This is the explanation why it exerts such a major influence on the propellant's ballistic and mechanical properties.

SYEP, when used as a partial or complete replacement for TVOPA, produced several more favorable results. These were:

(1) The explosive sensitivity of SYEP-containing propellants were found to be somewhat less sensitive than those of TVOPA-plasticized propellants;
(2) The mechanical properties, under ambient conditions, were also found to be somewhat superior;
(3) The burning rates at 1000 psia and 2000 psia were improved;
(4) Of particular significance was the marked improvement in the pressure exponent over the 1000 to 2000 psia range;
(5) The SYEP-containing propellant had a considerably higher propellant viscosity, but this could be effectively controlled and reduced through modification of the propellant composition.

The conclusion from the above results is that SYEP could be used as a partial or complete substitute for TVOPA if TVOPA were to become unavailable. A research facility determined that SYEP can be manufactured in a facility which had been designed for manufacture of TVOPA. Thus, if TVOPA becomes limited in supply or unavailable, then SYEP or SYPO could be manufactured and used as a partial or complete replacement for TVOPA as conditions warrant. The resulting propellant, as extensively evaluated, significantly effects the pressure exponent over the 1000 to 2000 psia range. The advantages which follow from the desired pressure exponent range of the solid propellant are of particular advantage for advanced interceptors.

TABLE 1

BASELINE PROPELLANT FORMULATION

| | PROPELLANT A WT. % | EXPERIMENTAL PROPELLANT B WT. % | EXPERIMENTAL PROPELLANT WT. % RANGE |
|---|---|---|---|
| INGREDIENT | | | |
| TVOPA | 27.54 | 22.03 | 0–22.03 |
| Ethyl Acrylate | 3.06 | 3.06 | 2.5–3.5 |
| ERL-4221* | 1.4 | 1.4 | 1.2–1.6 |
| Carboranylmethyl Propionate | 4.0 | 4.0 | 3.0–5.0 |
| Graphite Linter (100 μm) | 2.0 | 2.0 | 1.0–3.0 |
| Aluminum Powder (Alcoa 123) | 11.0 | 11.0 | 9.0–12.0 |
| Aluminum Flake (1RECO 2010) | 1.0 | 1.0 | 0.5–1.5 |
| Ammonium Perchlorate (1.0 μm) | 50.0 | 50.0 | 48.0–52.0 |
| Lecithin | 0.1 | 0.1 | 0.1–0.2 |
| SYEP | 0.0 | 5.51 | 27.54–5.5. |
| PROPERTIES | | | |
| Theoretical Specific Impulse (lb-s/lb) | 263.6 | 269 | |
| Density (lb/in$^3$) | 0.0637 | 0.648 | |
| Strand Burning Rates (ips) | | | |
| 1000 psia | 13.7 | 14.2 | |
| 2000 psia | 21.6 | 22.9 | |
| Pressure Exponent | 0.68 | 0.52 | |
| End-of-Mix Viscosity (KP 132° F.) | 17 | 25 | |
| MECHANICAL PROPERTIES | | | |
| Max. Stress (PSI) | 135 | 160 | |
| Strain Max. Stress (%) | 25 | 30 | |
| Modulus (PSI) | 850 | 900 | |
| SENSITIVITY PROPERTIES | | | |
| Electrostatic Discharge (Zero Initiation Level) (Volts/Joules) | 5000/6 | 5000/6 | |
| Friction (Zero Initiation Level) (ABL Apparatus) (90°) (PSI) | 500 | 500 | |
| Impact ($E_o$) (Kg-cm) | 5–10 | 8 | |
| Differential Scanning Calorimeter (°C.) | | | |
| Initial | 205 | 216 | |
| Peak | 233 | 250 | |

*4,5-Epoxycyclohexylmethyl 4,5-epoxycyclohexyl carboxylate (Curing Agent)

The compound SYPO can be substituted for TVOPA in a like manner as illustrated for the compound SYEP. The function of these compounds in reducing the pressure exponent while enhancing the burning rate of the illustrated composite propellant is unexpected. However, the importance of this function is more fully appreciated from a further review of additional data set forth. in Table II below and also presented graphically in the drawing to show the effect of uncontrolled pressure exponent, and the factors to which it exerts profound influences. The recognition of controlled pressure exponent by these compounds indicates the many advantages to missilry which can be achieved from their use.

A primary limitation to ultrahigh burning rate propellants is the increasing performance variability that may be expected with propellants having high burning rate slopes in the burning rate range intended for advanced interceptors. The increase in maximum motor operating pressure and action time (expressed as percentages) are tabulated in TABLE II for a nominal burning rate of 10 ips @ 2000 psia motor operating pressure with a tolerance of ±0.14 ips. These values were calculated for the burning rate of 10 ips based on Sprint First Stage grain configuration and a constant throat area sized for approximately 2000 psi nominal average pressure. These data show that the same variations in burning rate and slope will result in greatly amplified variations in performance as the pressure exponent is allowed to increase, especially above 0.65.

TABLE II

PERCENTAGE VARIATION IN PRESSURE AND ACTION TIME WITH PRESSURE EXPONENT

| | | MAXIMUM MOTOR | | | |
|---|---|---|---|---|---|
| PRESSURE EXPONENT | | OPERATING PRESSURE (%) | | ACTION TIME (%) | |
| 0.5 | 0.45 | +6.1 | −4.4 | +2.9 | −3.1 |
| 0.6 | 0.5 | +6.4 | −6.2 | +4.4 | −3.7 |
| 0.7 | 0.5 | +13.4 | −8.9 | +4.7 | −5.6 |
| 0.8 | 0.5 | +27.2 | −14.6 | +8.1 | −14.7 |

Figure 2:
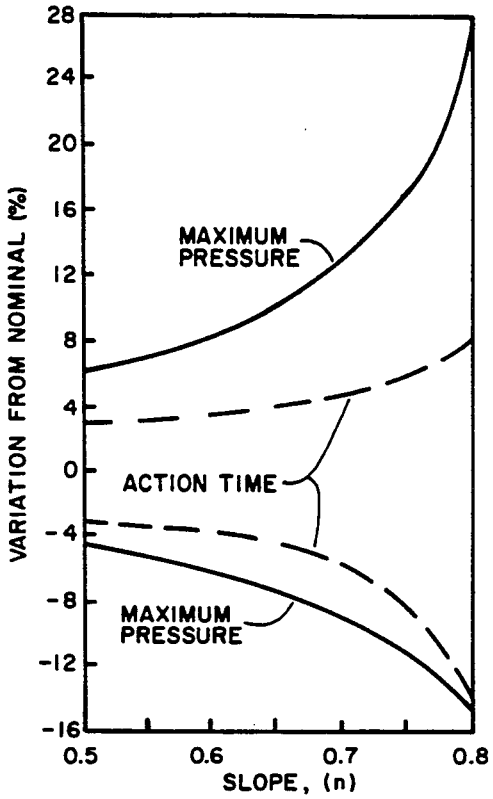
FIG. 2 is a graphic presentation of the variations of FIG. 1 wherein variation from nominal is plotted against slope.

In further reference to the drawing, FIG. 1 depicts the effect of pressure exponent on the motors maximum operating pressure. The notations on the curves of FIG. 1 include R=burning rate, and N=slope (i.e., ratio of pressure to burning rate). A graphic presentation of these variations is presented in FIG. 2.

Figure 3:
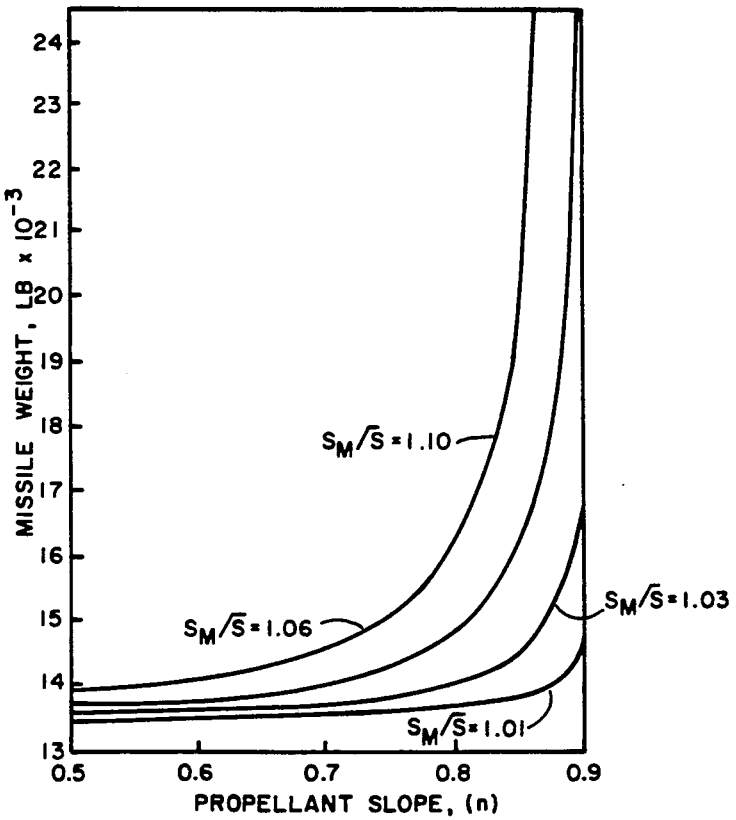
FIG. 3 is a graphic depiction of the effect of pressure exponent on missile weight.

FIG. 3 contains a graphic depiction of the effect of pressure exponent on missile weight.

The study motor parameters for the data depicted in FIG. 3 are: Wp=10,500; P=2500 psia; $R_b$=10 in/sec @ 2000 psia; and PL=500 lbs, wherein Wp=weight of propellant; P=pressure; $R_b$=burning rate; and PL=payload. The symbols $S_M/S$ equals ratio of missile weight to slope.

I claim:

1. A composite rocket propellant composition with a reduced pressure exponent and with an enhanced burning rate, said composite rocket propellant composition comprised of tris-1,2,3-[bis(1,2-difluoroamino)ethoxy]

propane in an amount from about 0 to about 22.03 weight percent of said composition; ethyl acrylate in an amount from about 2.5 to about 3.5 weight percent of said composition; 4,5-epoxycyclohexylmethyl 4,5-epoxycyclohexyl carboxylate in an amount from about 1.2 to about 1.6 weight percent of said composition; carboranylmethyl propionate in an amount from about 3.0 to about 5.0 weight percent of said composition; graphite linters of about 100 micrometers length in an amount from about 1.0 to about 3.0 weight percent of said composition; aluminum powder in an amount from about 9.0 to about 12.0 weight percent of said composition; aluminum flake in an amount 0.5 to about 1.5 weight percent of said composition; ammonium perchlorate of about 1.0 micrometers particle size in an amount from about 48.0 to about 52.0 weight percent of said composition; lecithin in an amount from about 0.1 to about 0.2 weight percent of said composition; and a geminal-(1,1-)difluoroamino compound selected from 2,2-bis(difluoroamino)-1,3-bis(fluorodinitroethoxy)propane and 2,2-bis(difluoroamino)-bis[5-fluoro-5,5-dinitro] pentyl formal in an amount from about 5.51 to about 27.54 weight percent of said composition.

2. The composite missile propellant composition with a reduced pressure exponent and with an enhanced burning rate of claim 1 wherein said tris-1,2,3-[bis(1,2-difluoroamino)ethoxy] propane is present in an amount of about 22.03 weight percent of said composition; said ethyl acrylate is present in an amount of about 3.06 weight percent of said composition; said 4,5-epoxycyclohexylmethyl 4,5-expoxycyclohexyl carboxylate is present in an amount of about 1.4 weight percent of said composition; said carboranylmethyl propionate is present in an amount of about 4.0 weight percent; said graphite linters are present in an amount of about 2.0 weight percent of said composition; said aluminum powder is present in an amount of about 11.0 weight percent of said composition; said aluminum flake is present in an amount of about 1.0 weight percent of said composition; said ammonium perchlorate is present in an amount of about 50.0 weight percent of said composition; said lecithin is present in an amount of about 0.1 weight percent of said composition; and said geminal-(1,1-)difluoroamino compound selected is 2,2-bis(difluoroamino)-1,3-bis(fluorodinitroethoxy) propane which is present in an amount of about 5.51 weight percent of said composition.

3. The composite missile propellant composition with a reduced pressure exponent and with an enhanced burning rate of claim 1 wherein said tris-1,2,3-[bis(1,2-difluoroamino)ethoxy] propane is present in an amount of about 22.03 weight percent of said composition; said ethyl acrylate is present in an amount of about 3.06 weight percent of said composition; said 4,5-epoxycyclohexylmethyl 4,5-epoxycyclohexyl carboxylate is present in an amount of about 1.4 weight percent of said composition; said carboranylmethyl propionate is present in an amount of about 4.0 weight percent; said graphite linters are present in an amount of about 2.0 weight percent of said composition; said aluminum powder is present in an amount of about 11.0 weight percent of said composition; said aluminum flake is present in an amount of about 1.0 weight percent of said composition; said ammonium perchlorate is present in an amount of about 50.0 weight percent of said composition; said lecithin is present in an amount of about 0.1 weight percent of said composition; and said geminal-(1,1-)difluoroamino compound selected is 2,2-bis(difluoroamino)-bis(5-fluoro-5,5-dinitro)pentyl formal which is present in an amount of about 5.51 weight percent of said composition.

* * * * *